US012460624B2

(12) United States Patent
Inaba

(10) Patent No.: US 12,460,624 B2
(45) Date of Patent: Nov. 4, 2025

(54) RECIPROCATING COMPRESSOR

(71) Applicant: MAYEKAWA MFG. CO., LTD., Tokyo (JP)

(72) Inventor: Takashige Inaba, Tokyo (JP)

(73) Assignee: MAYEKAWA MFG. CO., LTD., Tokyo (JP)

( * ) Notice: Subject to any disclaimer, the term of this patent is extended or adjusted under 35 U.S.C. 154(b) by 0 days.

(21) Appl. No.: 18/715,955

(22) PCT Filed: Dec. 12, 2022

(86) PCT No.: PCT/JP2022/045606
§ 371 (c)(1),
(2) Date: Jun. 3, 2024

(87) PCT Pub. No.: WO2023/120267
PCT Pub. Date: Jun. 29, 2023

(65) Prior Publication Data

US 2025/0059965 A1 Feb. 20, 2025

(30) Foreign Application Priority Data

Dec. 20, 2021 (JP) ..... 2021-206295

(51) Int. Cl.
*F04B 39/08* (2006.01)
*F04B 27/00* (2006.01)
(Continued)

(52) U.S. Cl.
CPC ..... *F04B 39/08* (2013.01); *F04B 39/10* (2013.01); *F04B 39/102* (2013.01); *F04B 49/22* (2013.01); *F04B 27/005* (2013.01)

(58) Field of Classification Search
CPC ..... F04B 27/005; F04B 39/08; F04B 39/10; F04B 39/102; F04B 49/22
See application file for complete search history.

(56) References Cited

U.S. PATENT DOCUMENTS 2,963,917 A * 12/1960 Villadsen ..... F04B 49/03 417/446
3,099,388 A * 7/1963 Villadsen ..... F04B 39/12 417/559
4,588,359 A 5/1986 Hikade

FOREIGN PATENT DOCUMENTS

DE 2429619 A1 * 1/1975
JP S3816183 B1 8/1963
(Continued)

OTHER PUBLICATIONS

International Search Report issued in International Appln. No. PCT/JP2022/045606 mailed Jan. 24, 2023. English translation provided.

(Continued)

*Primary Examiner* — Audrey B. Walter
(74) *Attorney, Agent, or Firm* — ROSSI, KIMMS & McDOWELL LLP

(57) ABSTRACT

A reciprocating compressor includes: a cylinder forming a cylinder chamber; an intake valve disposed around the cylinder chamber; a movable part including either an intake valve seat configured to seat the intake valve or a back member located on an opposite side of the intake valve from the intake valve seat, and configured to move in an axial direction of the cylinder; and an actuator for moving the movable part in the axial direction to change a movable range of the intake valve between the intake valve seat and the back member.

13 Claims, 9 Drawing Sheets

(51) Int. Cl.
*F04B 39/10* (2006.01)
*F04B 49/22* (2006.01)

(56) References Cited

FOREIGN PATENT DOCUMENTS

| | | | |
|---|---|---|---|
| JP | S59157175 | U | 10/1984 |
| JP | H06147125 | A | 5/1994 |
| JP | 2010077841 | A | 4/2010 |

OTHER PUBLICATIONS

Written Opinion issued in International Appln. No. PCT/JP2022/045606 mailed Jan. 24, 2023. English translation provided.
International Preliminary Report on Patentability issued in International Appln. No. PCT/JP2022/045606 mailed Jul. 4, 2024. English translation provided.

* cited by examiner

RECIPROCATING COMPRESSOR

TECHNICAL FIELD

The present disclosure relates to a reciprocating compressor.

BACKGROUND

Conventionally, a reciprocating compressor that can change operating states is known. For example, in Patent Document 1, an intake valve of a reciprocating compressor can be held open, and an operating state of the reciprocating compressor switches from a load operating state to a no-load operating state.

CITATION LIST

Patent Literature

Patent Document 1: JP2010-077841A

SUMMARY

Technical Problem

However, in the above-described patent document, it is difficult to finely adjust a gas intake amount in at least one of a plurality of cylinders disposed in the reciprocating compressor. Therefore, the reciprocating compressor may not be able to operate appropriately according to usage conditions.

An object of the present disclosure is to provide a reciprocating compressor capable of finely adjusting a gas intake amount in a cylinder.

Solution to Problem

A reciprocating compressor according to at least one embodiment of the present disclosure, includes: a cylinder forming a cylinder chamber; an intake valve disposed around the cylinder chamber; a movable part including either an intake valve seat configured to seat the intake valve or a back member located on an opposite side of the intake valve from the intake valve seat, and configured to move in an axial direction of the cylinder; and an actuator for moving the movable part in the axial direction to change a movable range of the intake valve between the intake valve seat and the back member.

Advantageous Effects

According to the present disclosure, it is possible to provide a reciprocating compressor capable of finely adjusting a gas intake amount in a cylinder.

DETAILED DESCRIPTION

Figure 1:
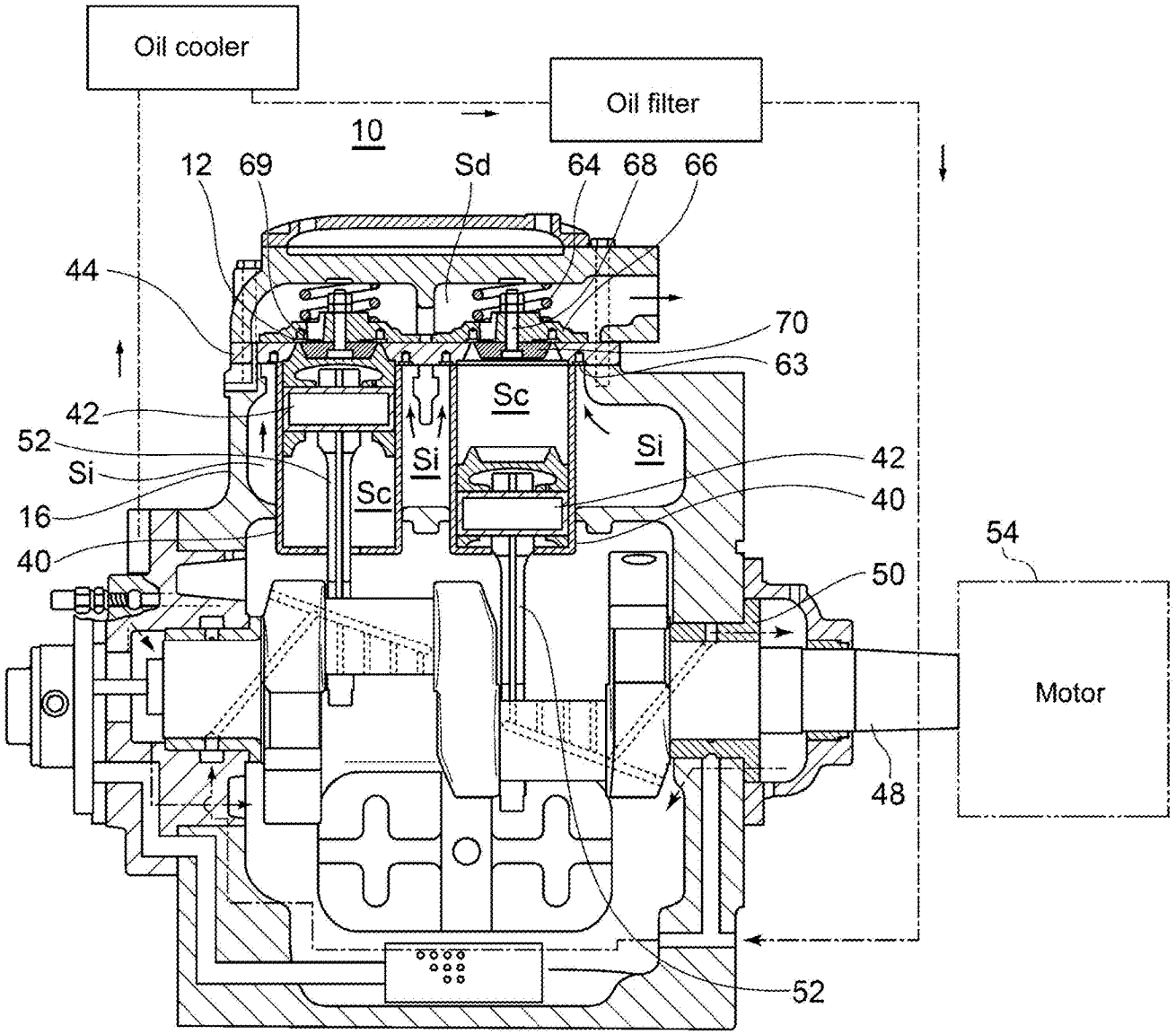
FIG. 1 is a conceptual cross-sectional view of a reciprocating compressor according to an embodiment.

Some embodiments of the present disclosure will be described below with reference to the accompanying drawings. It is intended, however, that unless particularly identified, dimensions, materials, shapes, relative positions and the like of components described or shown in the drawings as the embodiments shall be interpreted as illustrative only and not intended to limit the scope of the present disclosure.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same", "equal", and "uniform" shall not be construed as indicating only the state in which the feature is strictly equal, but also includes a state in which there is a tolerance or a difference that can still achieve the same function.

Further, for instance, an expression of a shape such as a rectangular shape or a tubular shape shall not be construed as only the geometrically strict shape, but also includes a shape with unevenness or chamfered corners within the range in which the same effect can be achieved.

On the other hand, the expressions "comprising", "including" or "having" one constitutional element is not an exclusive expression that excludes the presence of other constitutional elements.

The same configurations are indicated by the same reference characters and may not be described again in detail.

1. Overview of Reciprocating Compressor 10

FIG. 1 is a conceptual cross-sectional view of a reciprocating compressor 10 (hereinafter, may be referred to as the "compressor 10") according to an embodiment of the present disclosure. The compressor 10 is incorporated into a refrigeration cycle including a plurality of heat exchangers, for example, a condenser and an evaporator. As the refrigeration cycle, a binary refrigeration cycle, a two-stage compression refrigeration cycle, a reverse Brayton refrigeration cycle, or the like can be given. In this case, a gas compressed by the compressor 10 is a refrigerant gas.

In another embodiment, the compressor 10 may be incorporated into an internal combustion engine, etc. and a gas compressed by the compressor 10 may be a combustion gas, etc.

The compressor 10 according to an embodiment of the present disclosure includes a crankcase 16 and a plurality of cylinders 40 housed in the crankcase 16. Each cylinder 40 internally forms a cylinder chamber Sc where a piston 42 is housed. Each piston 42 is connected to a crank shaft 48, which is supported by a bearing 50 disposed in the crankcase 16, via a connecting rod 52, etc. Further, one end of the crank shaft 48 is connected to a motor 54, and each piston 42 can reciprocate inside each cylinder 40 when driven by the motor 54.

In the exemplary embodiment shown in FIG. 1, two cylinders 40 are disposed in parallel, and the pistons 42 in the two cylinders 40 are connected to the crank shaft 48 so as to reciprocate in phases different by 180° at a rotation angle of the crank shaft 48.

In the following description, the axial direction of the cylinder 40 may simply be referred to as the "axial direction". In the present embodiment, the axial direction coincides with the vertical direction, and the crank shaft 48 extends in the horizontal direction.

On one end side of the cylinder 40 (an upper end side of the cylinder 40 in FIG. 1), a valve plate 44 for supporting a discharge valve 12 is disposed. Inside an opening formed in the valve plate 44, a discharge valve seat 70 in truncated conical shape is arranged. The discharge valve seat 70 is coupled to a valve cage 66 by a bolt 68, and the discharge valve 12 is held between the discharge valve seat 70 and the valve cage 66. The valve cage 66 is biased toward the cylinder 40 by a head spring 64. Further, the discharge valve 12 is biased toward the discharge valve seat 70 by a valve spring (not shown) housed in a spring hole 69 disposed in the valve cage 66.

The compressor 10 according to an embodiment of the present disclosure further includes an intake valve 63 disposed around the cylinder chamber Sc of the cylinder 40, and an intake valve seat 61 (see FIG. 2) configured to seat the intake valve 63. The intake valve 63 has an O-ring shape extending continuously over the circumferential direction with the axis of the cylinder 40 as a reference. In another embodiment, the intake valve 63 may be a plurality of plate valves arranged along the circumferential direction.

An overview of an operation of the compressor 10 shown in FIG. 1 is as follows.

When the piston 42 is lowered and a closed space in the cylinder chamber Sc is depressurized as the motor 54 is driven, a pressure in an intake space Si formed outside the cylinder 40 exceeds the pressure in the closed space by a certain degree. The intake valve 63 seated on the intake valve seat 61 is pushed up, and a gas in the intake space Si is sucked into the cylinder chamber Sc through the intake valve seat 61. Thereafter, the piston 42 finishes its descent and begins to rise. As a result of the gas being compressed by the piston 42 and the closed space being pressurized, the intake valve 63 is pushed down and seated on the intake valve seat 61. When the piston 42 rises further and the pressure in the closed space exceeds a pressure in a discharge space Sd by a certain degree, the discharge valve 12 is pushed up and the compressed gas in the cylinder chamber Sc is discharged to the discharge space Sd.

In the present embodiment, it is configured such that a movable range of the intake valve 63 during operation of the compressor 10 is changed. The movable range can be changed by moving either the intake valve seat 61 or a back member 65 (described later) in the axial direction. Hereinafter, a compressors 10A (10) according to the first embodiment, which is configured to move the intake valve seat 61, and compressors 10B and 10C (10) according to the second embodiment, which are configured to move the back member 65, will be exemplified in sequence.

2. Compressor 10A (10) According to First Embodiment

Figure 2:
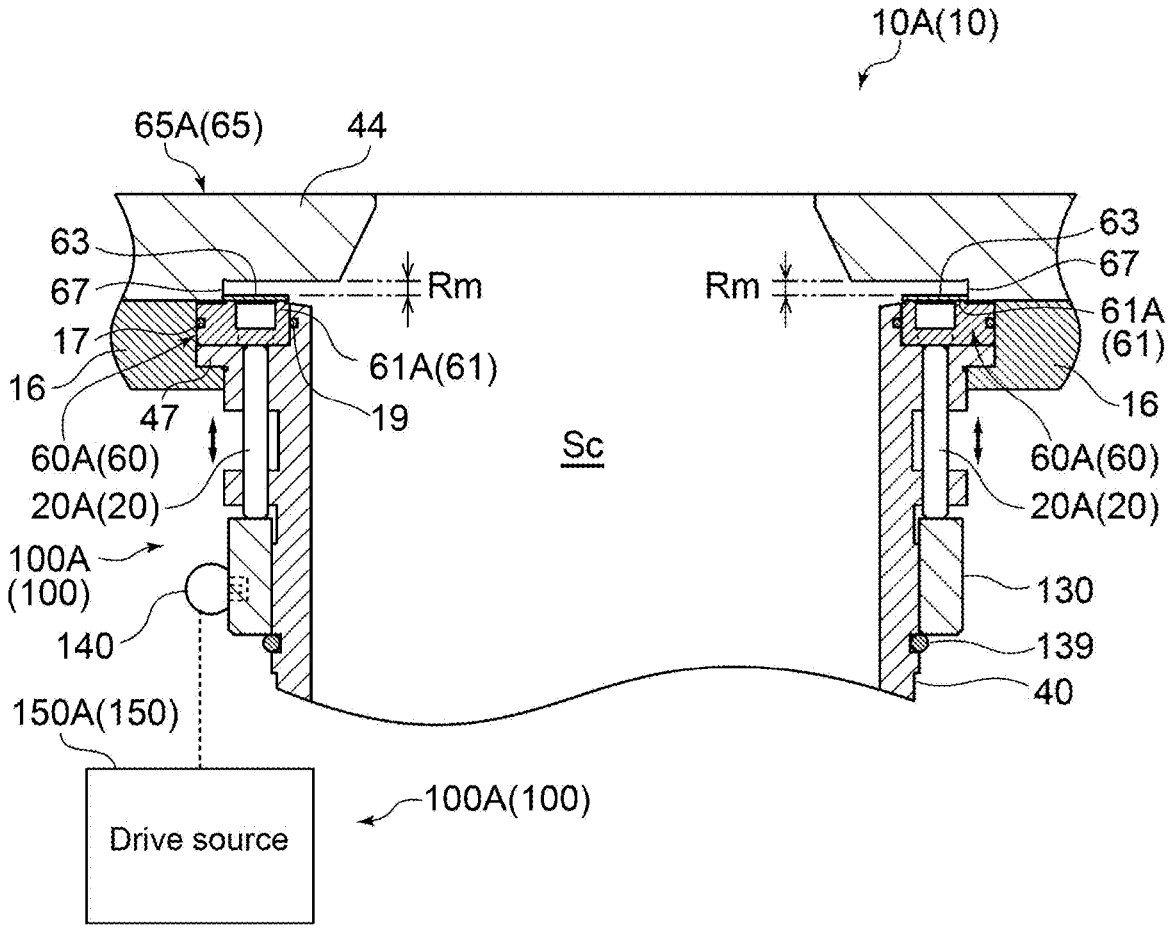
FIG. 2 is a cross-sectional view conceptually showing the reciprocating compressor according to the first embodiment.
Figure 3:
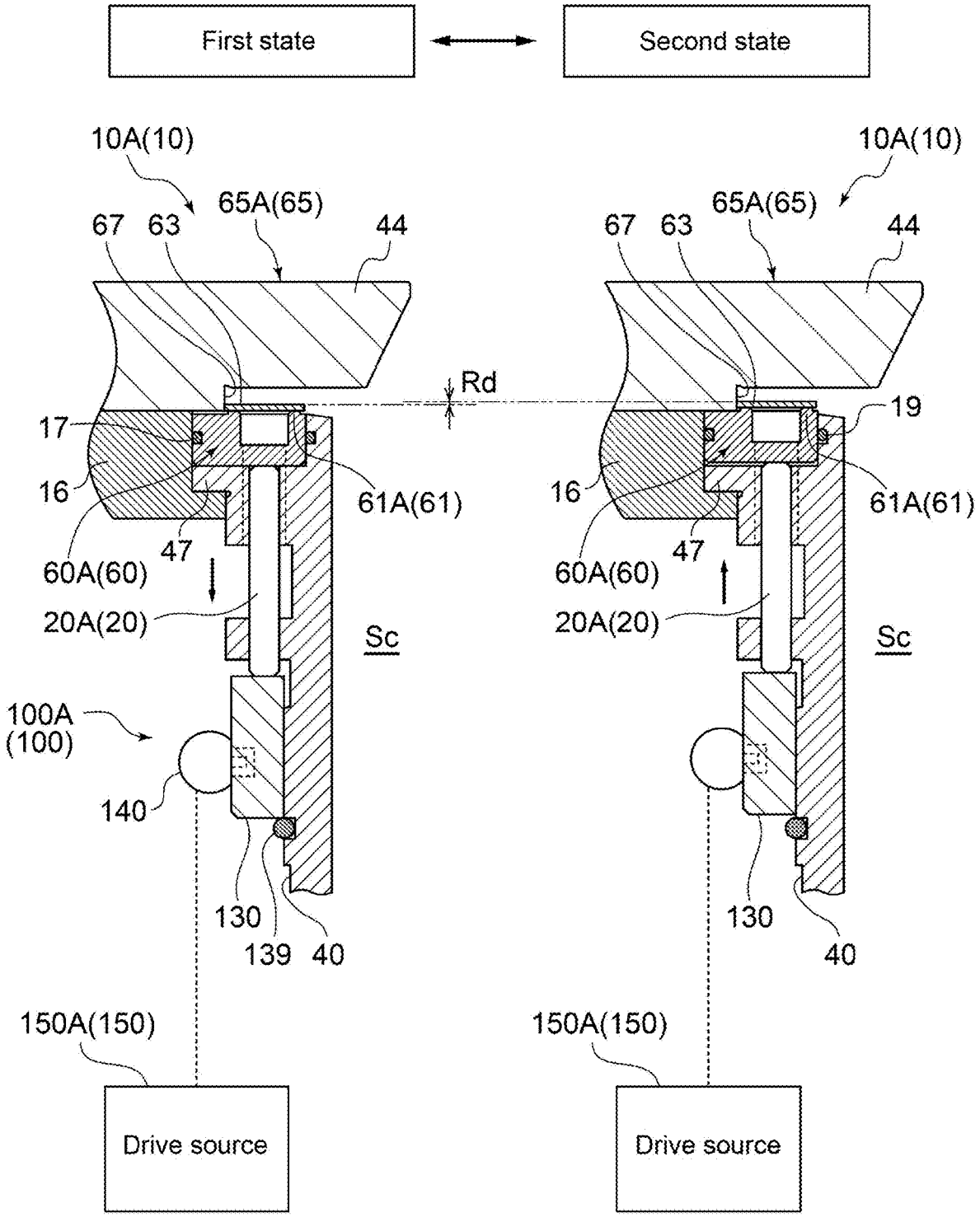
FIG. 3 is a cross-sectional view conceptually showing an adjustment width of a movable range of an intake valve according to an embodiment.
Figure 4A:
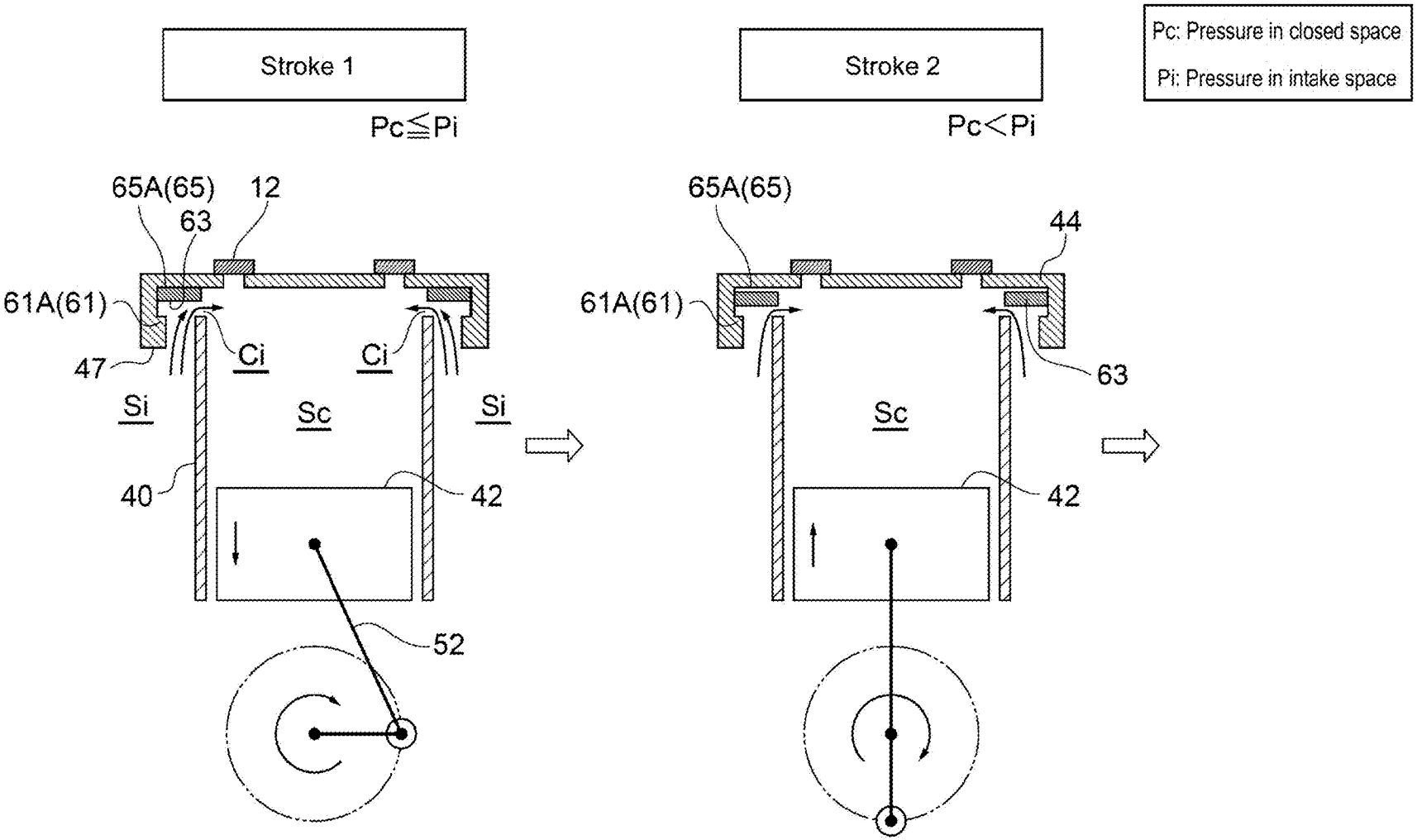
FIG. 4A is an explanatory view conceptually showing a gas intake stroke of the reciprocating compressor in a second state according to an embodiment.
Figure 4B:
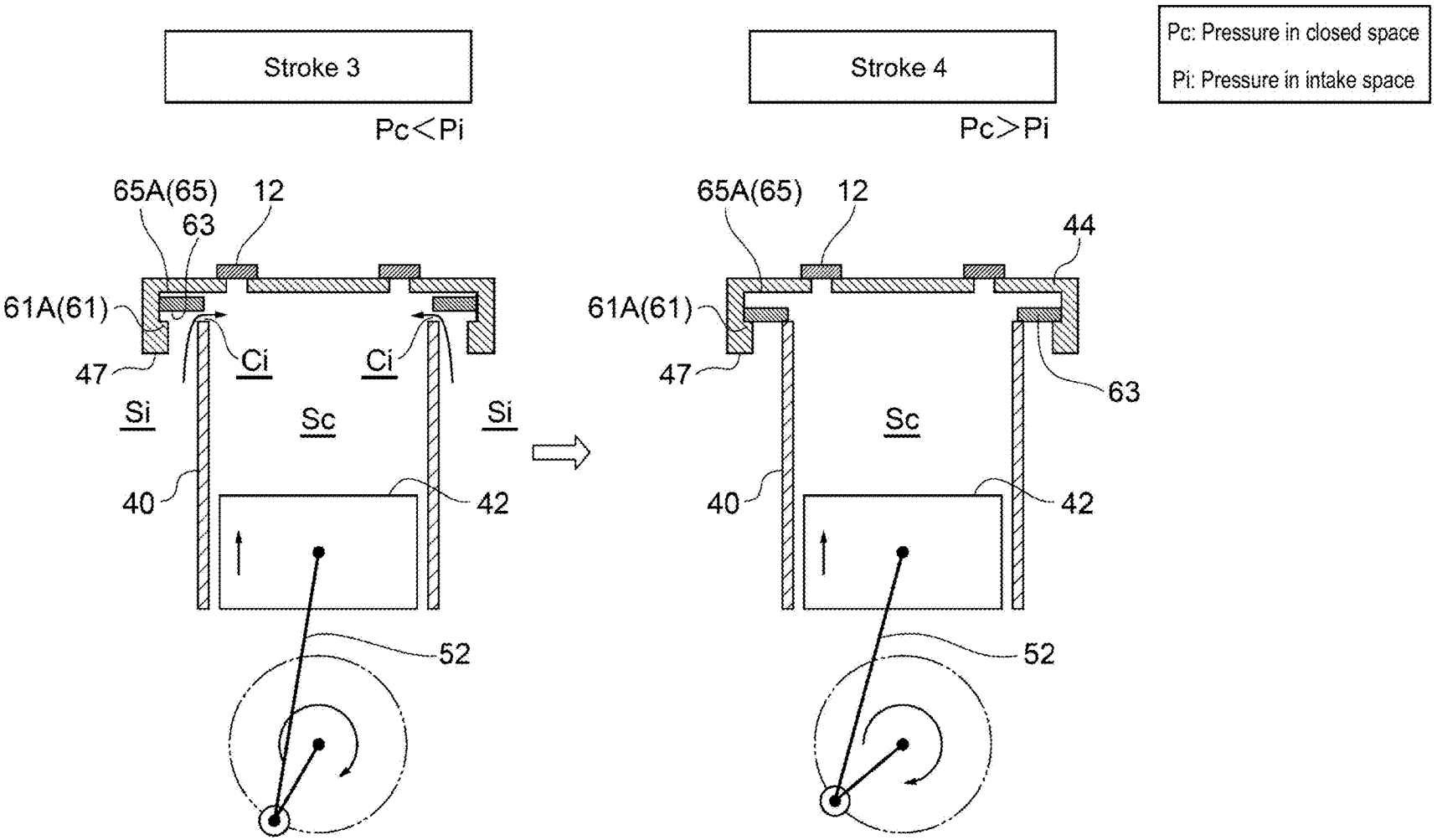
FIG. 4B is an explanatory view conceptually showing the gas intake stroke of the reciprocating compressor, following FIG. 4A.
Figure 5:
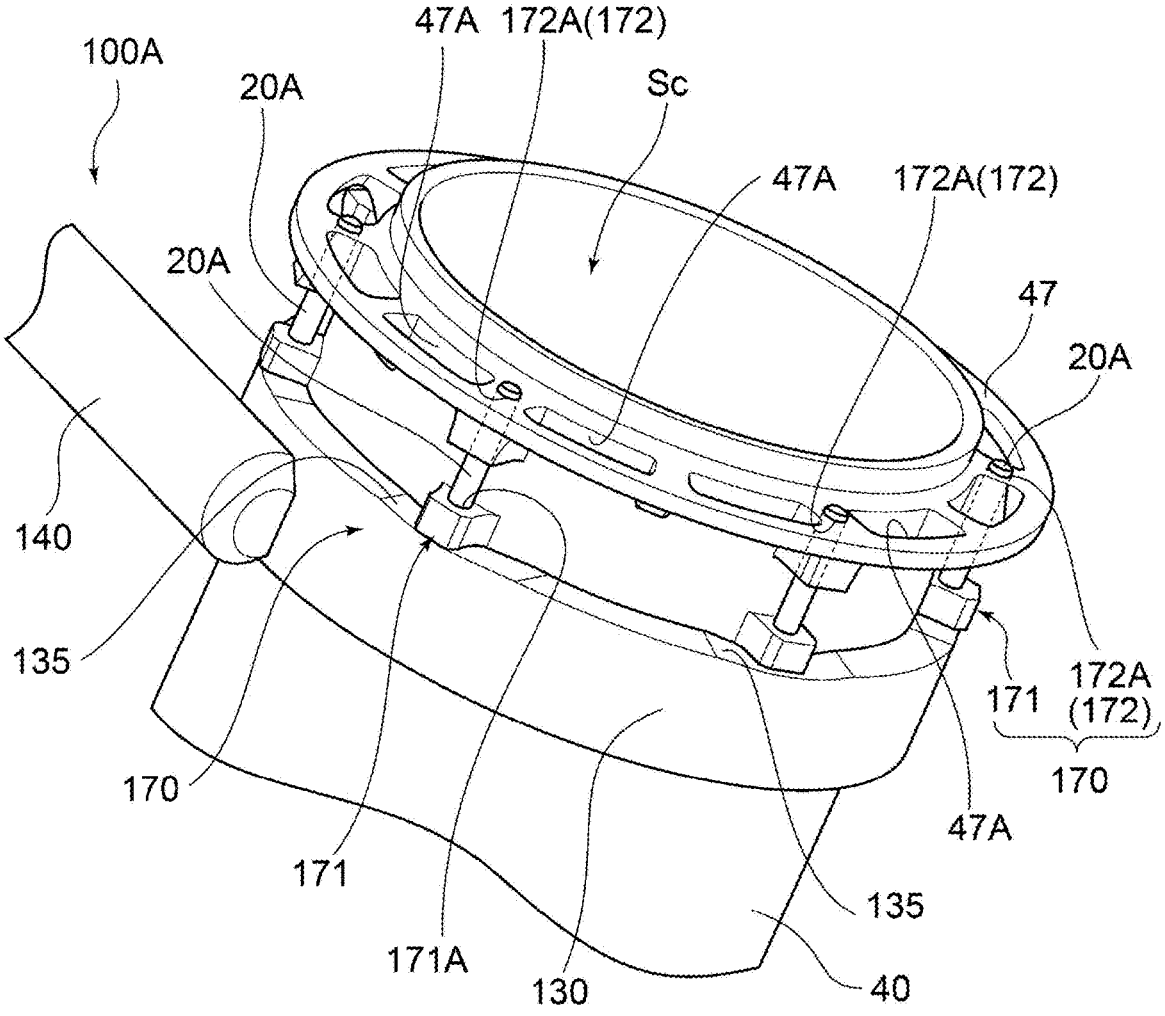
FIG. 5 is a perspective view conceptually showing a cylinder according to an embodiment.
Figure 6:
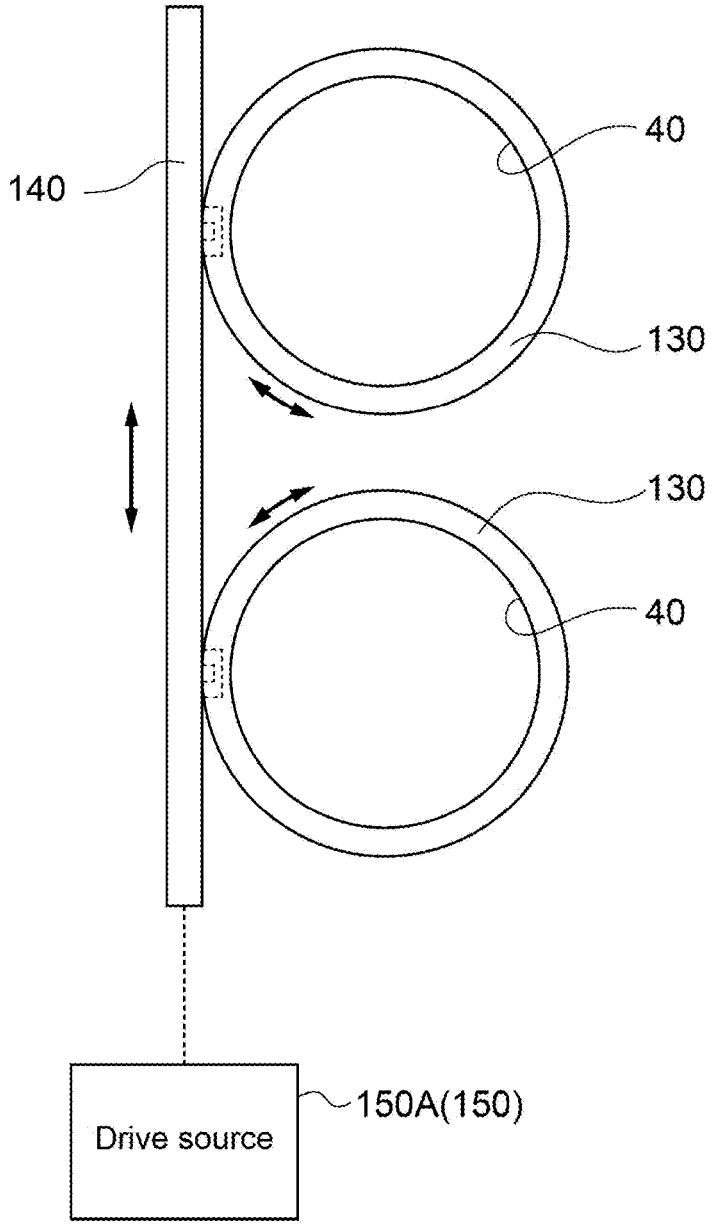
FIG. 6 is an explanatory view conceptually showing a plurality of cylinders according to an embodiment.

The compressor 10 (10A) according to the first embodiment will be exemplified with reference to FIGS. 2 to 6. FIG. 2 is a cross-sectional view conceptually showing the cylinder 40 of the reciprocating compressor 10A according to an embodiment of the present disclosure. FIG. 3 is a cross-sectional view conceptually showing an adjustment width of the movable range of the intake valve 63 according to an embodiment of the present disclosure. FIG. 4A, 4B is an explanatory view conceptually showing a stroke when the reciprocating compressor 10A in a second state sucks in a gas according to an embodiment of the present disclosure. FIG. 5 is a perspective view conceptually showing the cylinder 40 according to an embodiment of the present disclosure. FIG. 6 is an explanatory view conceptually showing the plurality of cylinders 40 according to an embodiment of the present disclosure.

<2-1. Overview of Configuration of Compressor 10A>

As shown in FIG. 2, in the first embodiment, the above-described intake valve seat 61A (61) is a separate member from an outer peripheral portion of the cylinder 40 and is configured to move in the axial direction. The intake valve seat 61A can be placed on a flange 47 disposed opposite to the intake valve 63. The flange 47 is formed integrally with the outer peripheral portion of the cylinder 40 as an example, and has an O-ring shape extending continuously in the circumferential direction over the entire circumference of the cylinder 40. In this flange 47, a plurality of channels 47A (see FIG. 5) for the gas sucked into the cylinder chamber Sc to flow are arranged along the circumferential direction of the cylinder 40.

The intake valve seat 61A of the present embodiment is disposed between the outer peripheral portion of the cylinder 40 and an opening portion disposed in the crankcase 16. An inner sealing member 19 is fitted into a groove formed over the entire circumference of the outer peripheral portion of the cylinder 40. The inner sealing member 19 is configured to restrict the gas from passing between the cylinder 40 and the intake valve seat 61A. The inner sealing member 19 is, as an example, an elastically deformable O-ring and presses against the intake valve seat 61A.

Further, an outer sealing member 17 is fitted into a groove formed over the entire circumference of an outer peripheral portion of the intake valve seat 61A. The outer sealing member 17 is configured to restrict the gas from passing between the intake valve seat 61A and the crankcase 16. The outer sealing member 17 is, as an example, an elastically deformable O-ring and presses against the crankcase 16.

The compressor 10A shown in FIG. 2 has a back member 65A (65) located on the opposite side of the intake valve 63 from the intake valve seat 61A. The back member 65A according to the first embodiment is the same member as the above-described valve plate 44 and is fixed at a prescribed position. As an example, the intake valve 63 pushed up from the intake valve seat 61 abuts on the back member 65A. The movable range of the intake valve 63 corresponds to a dimension Rm. Further, the back member 65A includes an intake valve guide surface 67 facing radially inward of the cylinder 40 and configured to guide the intake valve 63 in the axial direction. Whereby, the intake valve seat 61 can move stably in the axial direction.

In another embodiments, for example, a spring may be interposed between the back member 65A and the intake valve 63, and the intake valve 63 in this case may not abut on the back member 65A.

As already described, in the first embodiment, of the intake valve seat 61A or the back member 65A, the intake valve seat 61A is configured to move in the axial direction. Whereby, a seating position of the intake valve seat 61 is adjusted in the axial direction, changing the movable range of the intake valve 63 between the intake valve seat 61A and the back member 65A. Hereinafter, in the description of the first embodiment, of the intake valve seat 61A or the back member 65A, the intake valve seat 61A may be referred to as a "movable part 60A". The movable part 60A (60) is moved by an actuator 100A which is a component of the compressor 10A. Details of the actuator 100A will be described later.

Switching of the movable range of the intake valve 63 due to movement of the movable part 60A will be described with reference to FIG. 3. The compressor 10A changes between a first state where the intake valve seat 61A which is the movable part 60A is placed on the flange 47 and a second state where the intake valve seat 61A is separated from the flange 47. The movable range of the intake valve 63 at this time corresponds to a dimension Rd. The dimension Rd is equal to a separation distance between the intake valve seat 61A and the flange 47 in the second state. When the compressor 10A is in the second state, the movable range of the intake valve 63 is narrow compared to the first state. In this case, the gas intake amount of cylinder 40 is reduced, as described in detail later.

<2-2. Intake Operation of Compressor 10A when Gas Intake Amount is Reduced>

A stroke per cycle, where the cylinder 40 of the compressor 10A in the second state sucks in the gas, will be described with reference to FIG. 4A, 4B. FIG. 4A, 4B conceptually illustrates a mechanism including the cylinder 40 as viewed from the axial direction of the crank shaft 48. The following description about the gas intake stroke does not take into account influences of the biasing forces of the head spring 64 and the valve spring, which are described with reference to FIG. 1. In addition, influences of self-weights of the various parts such as the piston 42, the intake valve 63, the discharge valve 12, and the valve cage 66 are not considered, either.

As shown in FIG. 4A, as the piston 42 descends, a pressure (Pc) in the closed space within the cylinder chamber Sc decreases and becomes not greater than a pressure (Pi) in the intake space Si. At this time, the intake valve 63 is pushed up from the intake valve seat 61A, opening an intake gas channel Ci (Stroke 1). The gas in the intake space Si sequentially passes through the intake valve seat 61 and the intake gas channel Ci, and flows into the cylinder chamber Sc. As the piston 42 further descends toward a lower end of a moving range, the gas is further sucked into the cylinder chamber Sc (Stroke 2). Herein, when the compressor 10A is in the second state, since the channel cross-sectional area of the intake gas channel Ci is small, the gas intake amount which is the flow rate of the gas sucked into the cylinder chamber Sc is limited compared to the first state.

As shown in FIG. 4B, the closed space within the cylinder chamber Sc is pressurized (Stroke 3) when the piston 42 begins to rise as a crank pin 53 passes through a bottom dead center.

If the compressor 10A is in the first state, for example, and the sufficient gas is sucked into the cylinder chamber Sc at the time of Stroke 2, the pressure (Pc) in the closed space within the cylinder chamber Sc becomes not less than the pressure (Pi) in the intake space Si immediately after the piston 42 begins to rise. However, the sufficient gas is not sucked into the cylinder chamber Sc when the compressor 10A is in the second state, delaying a timing at which the pressure (Pc) in the closed space becomes not less than the pressure (Pi) in the intake space Si. As a result, a timing at which the intake valve 63 is seated on the intake valve seat 61A is delayed, that is, a so-called closing delay of the intake valve 63 occurs (Stroke 4).

The discharge stroke of the cylinder 40, which is performed after the intake stroke has already been described, and since the gas intake amount in the cylinder 40 is small, volumetric efficiency of the compressor 10A is low compared to the first state. That is, the output of the compressor 10A is low.

However, when the piston 42 performs rising movement (Stroke 3, 4), the pressure in the cylinder chamber Sc is not sufficiently high, and thus a load applied to the piston 42 is low compared to the first state. Therefore, an output torque required for the motor 54 driving the piston 42 is reduced and power consumption of the motor 54 is reduced. Further, since the output torque required for the motor 54 is reduced, a mechanical loss is also reduced when the piston 42 reciprocates by power of the motor 54. Therefore, adiabatic efficiency of the compressor 10A is improved under conditions such as when the degree of the power reduction of the motor 54 is greater than the degree of the output reduction of the compressor 10A.

Accordingly, in the compressor 10A in the second state, compared to the first state, the output is low, but highly efficient operation with reduced power consumption is possible.

Although detailed illustration is omitted, for example, in an embodiment where the compressor 10A is incorporated into the refrigeration cycle, the compressor 10A is operated in the first state when a refrigeration device using cold heat obtained by the refrigeration cycle is in startup operation. At this time, since the output of the compressor 10A is high, it is possible to obtain an advantage such as a reduction in time required for a circulating refrigerant to drop to a prescribed temperature. Further, when the refrigeration device is in rated operation, since the output required of the compressor 10A is relatively low, the compressor 10A is operated in the second state. Whereby, it is possible to obtain an advantage such as being able to reduce power consumption of the refrigeration device during the rated operation.

A specific example where the compressor 10A switches to the first state or the second state is not limited to the above. To take another example, the compressor 10A may temporarily switch from the second state to the first state if a heat load applied to the refrigeration device during the rated operation changes. Whereby, the refrigeration device can quickly respond to the change in heat load.

To take still another example, the compressor 10A may be operated routinely in either the first state or the second state, depending on specifications of the refrigeration device, such as the type of circulating refrigerant or usage conditions of the heat exchanger forming the refrigeration cycle. Thus, the compressor 10A can exhibit its performance appropriately depending on the type of refrigeration device into which the compressor 10A is incorporated, achieving high versatility of the compressor 10A.

As described above, the compressor 10A includes the actuator 100A for moving the movable part 60A which is the intake valve seat 61A in the axial direction, the actuator 100A changes the movable range of the intake valve 63 between intake valve seat 61A and the back member 65A, and the channel cross-sectional area of the intake gas channel Ci formed between the activated intake valve 63 and the intake valve seat 61A can be changed. Therefore, it is possible to achieve the compressor 10A capable of adjusting step by step the gas intake amount in the cylinder 40. Therefore, the compressor 10A can be adapted to various operating conditions, such as operating conditions that require high output or operating conditions that require reduced power consumption.

The output of the compressor 10A can also be controlled by so-called unloader control in which any of the plurality of cylinders 40 is subjected to idle operation (no-load operation). This can be achieved by providing an unloader mechanism configured to constantly separate the intake valve 63 from the intake valve seat 61A (61) during rising and descending of the piston 42. However, when the operating state of the cylinder 40 switches between load operation and no-load operation, a difference in gas discharge amount of the compressor 10A is large, making fine output control of the compressor 10A difficult (for example, if the number of cylinders 40 mounted in the compressor 10A is eight, the output of the compressor 10A is controlled in 12.5% increments, making the fine output control difficult). Therefore, for example, if unloader control is performed in order to reduce the output of the compressor 10A, the output may excessively be lower than a proper value.

In this regard, in the present disclosure, the load operating state in one cylinder 40 can be adjusted by adjusting the movable range of the intake valve 63, making it possible to finely adjust the output of the compressor 10A. The compressor 10A of the present disclosure may include the unloader mechanism in addition to the mechanism for adjusting the movable range of the intake valve 63.

Further, although the output of the compressor 10A can also be controlled by controlling the rotation speed of the motor 54, this requires installation of an inverter for controlling the frequency of electric power supplied to the motor 54, which may increase the cost of the compressor 10A. In this regard, it is not essential to install the inverter in the present disclosure, making it possible to achieve the fine output control while suppressing the increase in cost of the compressor 10A.

Further, in the present embodiment, the movable part 60A which is the intake valve seat 61A has a ring shape extending continuously along the circumferential direction of the cylinder 40. As a more specific example, the movable part 60A has the O-ring shape extending continuously over the entire circumference in the circumferential direction of the cylinder 40. Whereby, compared to a case where a plurality of movable parts 60A are arranged along the circumferential direction (in more detail, a case where the intake valve 63 is a reed valve), the number of parts forming the compressor 10A is reduced, making it possible to simplify the configuration of the actuator 100A.

Further, in the present embodiment, the movable part 60A configured to move in the axial direction corresponds to, of the back member 65A or the intake valve seat 61, the intake valve seat 61, and there is no need to move the back member 65A in the axial direction. Whereby, it is possible to simplify the configuration of the actuator 100A.

Further, the back member 65A includes the intake valve guide surface 67 configured to guide the intake valve 63 in the axial direction. Whereby, the intake valve 63 can stably be activated even when an axial distance between the intake valve seat 61 and the back member 65A is changed by the actuator 100.

<2-3. Details of Configuration of Actuator 100A>

The details of the configuration of the actuator 100A (100) will be exemplified with reference to FIG. 2, 3, 5, 6.

As shown in FIG. 2, 3, in the present embodiment, the actuator 100A includes a drive source 150A (150) and a moving member 20A (20) for moving the movable part 60A by a driving force transmitted from the drive source 150A. The moving member 20A can narrow and widen the movable range of the intake valve 63 by moving the movable part 60A, and is located on a movable part 60A side with respect to the intake valve 63 (in the example of FIG. 3, a lower side with respect to the intake valve 63). As a more specific example, the moving member 20A is disposed in the outer peripheral portion of the cylinder 40 on an opposite side of the intake valve seat 61A from the back member 65A.

The moving member 20A of the present embodiment is a pin extending in the axial direction, as described later. In another embodiment, the moving member 20A may be a ring rotatably disposed in the outer peripheral portion of the cylinder 40.

According to the above configuration, since the moving member 20A is located on the movable part 60A side with respect to the intake valve 63, the components of the actuator 100A are concentrated on the movable part 60A side with respect to the intake valve 63. Therefore, compared to a case where the moving member 20A is arranged, for example, on a back member 65A side with respect to the intake valve 63, the actuator 100A can be made more compact.

The actuator 100A of the present embodiment includes a cam ring 130 located on an opposite side of the moving member 20A from the intake valve seat 61A. The cam ring 130 is placed on a retaining ring 139 disposed in the outer peripheral portion of the cylinder 40 and is configured to rotate around the axis of the cylinder 40 by the driving force transmitted from the drive source 150A.

Further, as shown in FIG. 5, the cam ring 130 has a cam surface 135 inclined with respect to a rotational direction and abutting on the moving member 20A. The cam surface 135 of the present embodiment supports the moving member 20. Therefore, when the cam surface 135 slides against the moving member 20A as the cam ring 130 rotates, the cam ring 130 can move the moving member 20A and the intake valve seat 61A (see FIG. 3) in the axial direction. In the present example, when the cam ring 130 rotates in one direction, the moving member 20 rises together with the intake valve seat 61A and the movable range of the intake valve 63 is narrowed. Then, when the cam ring 130 rotates in the other direction, an abutment position between the cam surface 135 and the moving member 20A changes to the lower side. Whereby, the moving member 20 and the intake valve seat 61A both move downward, and the movable range of the intake valve 63 is widened. In the present embodiment, after the intake valve seat 61A is placed on the flange 47, the moving member 20A still moves further downward (the intake valve seat 61A and the moving member 20A are separated from each other).

According to the above configuration, since the configuration is adopted in which the rotational motion of the cam ring 130 is converted into the movement along the axial direction of the moving member 20A, it is possible to reduce the necessity of arranging a large number of movable parts of the actuator 100A on the opposite side of the cam ring 130 from the moving member 20A. Therefore, the actuator 100A can be made more compact in the axial direction.

As shown in FIG. 5, the actuator 100A of the present embodiment includes a linear motion member 140 configured to rotate the cam ring 130 along with linear movement. The linear motion member 140 is, as an example, a rod extending in a direction intersecting the axial direction. The above-described drive source 150A is configured to provide the driving force to the linear motion member 140 (see FIG. 6). The drive source 150A is, as an example, a hydraulic cylinder. As a position of the linear motion member 140 switches with the drive of the hydraulic cylinder, a rotational position of the cam ring 130 also switches. Whereby, the compressor 10A changes between the first state and the second state.

In the present embodiment, a protruding portion is disposed on any one of an outer peripheral surface of the cam ring 130 or an outer peripheral surface of the linear motion member 140, and a recessed portion housing the protruding portion is disposed on any of the other. Whereby, the linear motion member 140 linearly moving can push the cam ring 130 in the rotational direction, and the driving force is transmitted from the drive source 150A to the cam ring 130.

In another embodiment, the above-described protruding portion and recessed portion may not be disposed. For example, an end surface of the cam ring 130 opposite to the cam surface 135 is inclined with respect to the rotational direction, and the linear motion member 140 may have an abutment surface facing and abutting on this inclined end surface. Even in this case, the cam ring 130 can rotate as the linear motion member 140 moves linearly.

Further, the drive source 150A may be an air cylinder, a solenoid, a motor, or the like. For example, when the motor is adopted as the drive source 150A, the amount of the movement of the linear motion member 140 can be adjusted steplessly, making it possible to steplessly adjust the movable range of the intake valve 63.

According to the above configuration, since the cam ring 130 rotates simply by the linear movement of the linear motion member 140 driven by the drive source 150A, it is possible to simplify the configuration of the actuator 100A.

Further, as shown in FIG. 6, in the present embodiment, the single linear motion member 140 is configured to rotate the cam ring 130 of each of the plurality of cylinders 40 (two cylinders 40 in the example of the figure). Whereby, since the number of drive sources 150A of the actuator 100A is reduced, it is possible to simplify the configuration of the actuator 100A. The adjustment of the gas intake amount is not limited to being performed simultaneously in the plurality of cylinders 40. For example, a configuration is adopted in which arrangement is done such that phases on a tapered surface of the recessed portion or the protruding portion disposed in the cam ring 130 are different among the plurality of cylinders 40, and if a configuration is adopted in which the amount of the movement of the linear motion member 140 can be controlled, a timing at which the gas intake amount is adjusted can be staggered among the plurality of cylinders 40. Whereby, it is possible to finely and flexibly adjust the gas intake amount in each of the plurality of cylinders 40. A configuration may be adopted in which the intake amount in one cylinder 40 is reduced when the linear motion member 140 moves in one direction, and the intake amount in the other cylinder 40 is reduced when the linear motion member 140 moves in another direction.

Returning to FIG. 5, a plurality of moving members 20A of the present embodiment are arranged at equal intervals along the circumferential direction of the cylinder 40. The moving members 20A are, as an example, pins extending in the axial direction. Then, a plurality of cam surfaces 135 of the cam ring 130 described above are disposed corresponding to the plurality of moving members 20A, respectively.

According to the above configuration, the plurality of cam surfaces 135 respectively slide against the plurality of moving members 20A, causing the plurality of moving members 20A each having the pin shape to move the intake valve seat 61A. Since the intake valve seat 61A is moved by the plurality of moving members 20A, it is possible to stabilize the movement of the intake valve seat 61.

The actuator 100A of the present embodiment includes a guide 170 configured to guide the moving member 20A in the axial direction. In the present embodiment, a plurality of guides 170 are disposed corresponding to the plurality of moving members 20A, respectively. Each guide 170 includes a first guide 171 and a second guide 172 which are spaced apart from each other in the axial direction. The first guide 171 has a projection disposed on an outer peripheral surface of the cylinder 40 at a position proximate to the cam ring 130, and a first guide hole 171A disposed in the projection. One end portion (lower end portion) of the moving member 20A, which is formed in a pin shape, is arranged inside the first guide hole 171A. The second guide 172 includes a second guide hole 172A disposed in the flange 47. Another end portion (upper end portion) of the moving member 20A is arranged inside the second guide hole 172A. In the present example, the second guide hole 172A is disposed between any two among the above-described plurality of channels 47A formed in the flange 47.

According to the above configuration, the moving member 20A is located on the inner side relative to an outer peripheral end of the flange 47, in the radial direction of the cylinder 40. Therefore, the actuator 100A can be made more compact in the radial direction of the cylinder 40.

3. Compressor 10B, 10C According to Second Embodiment

Figure 7:
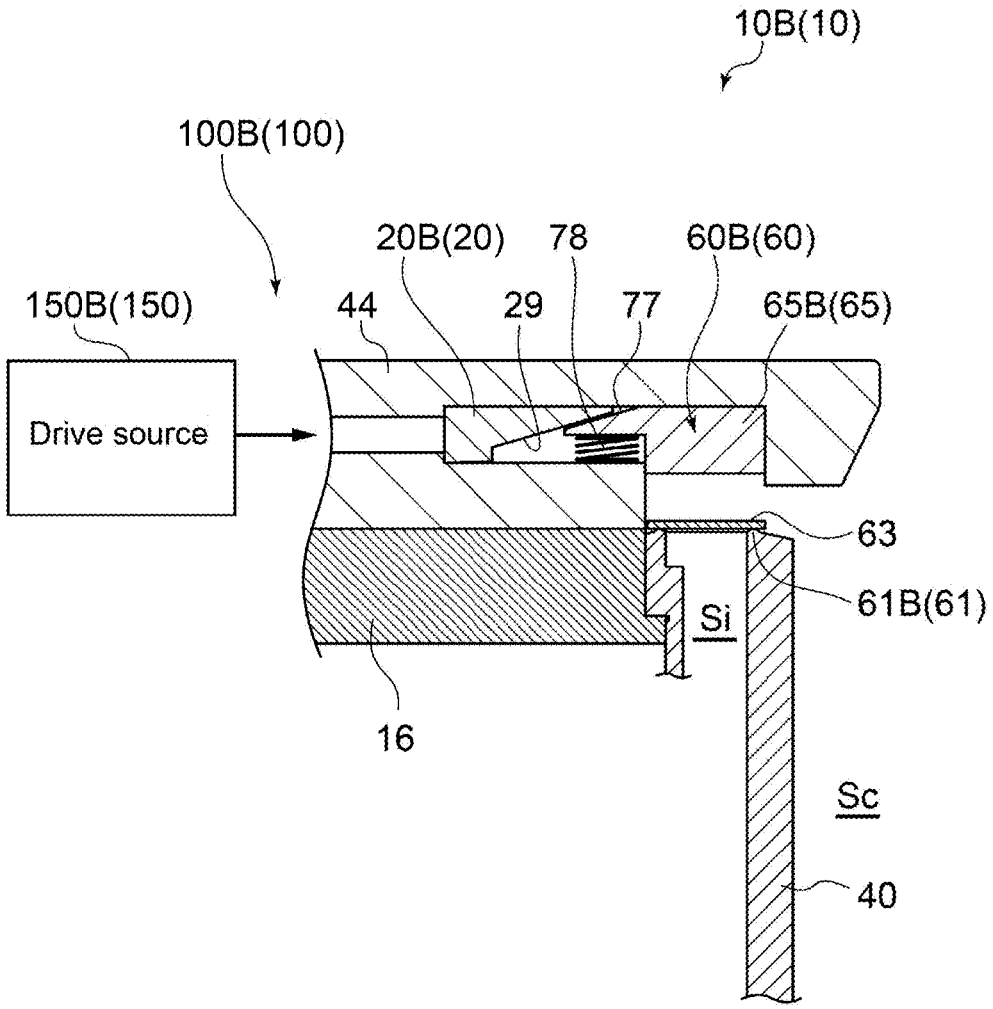
FIG. 7 is a cross-sectional view conceptually showing a reciprocating compressor according to the second embodiment.
Figure 8:
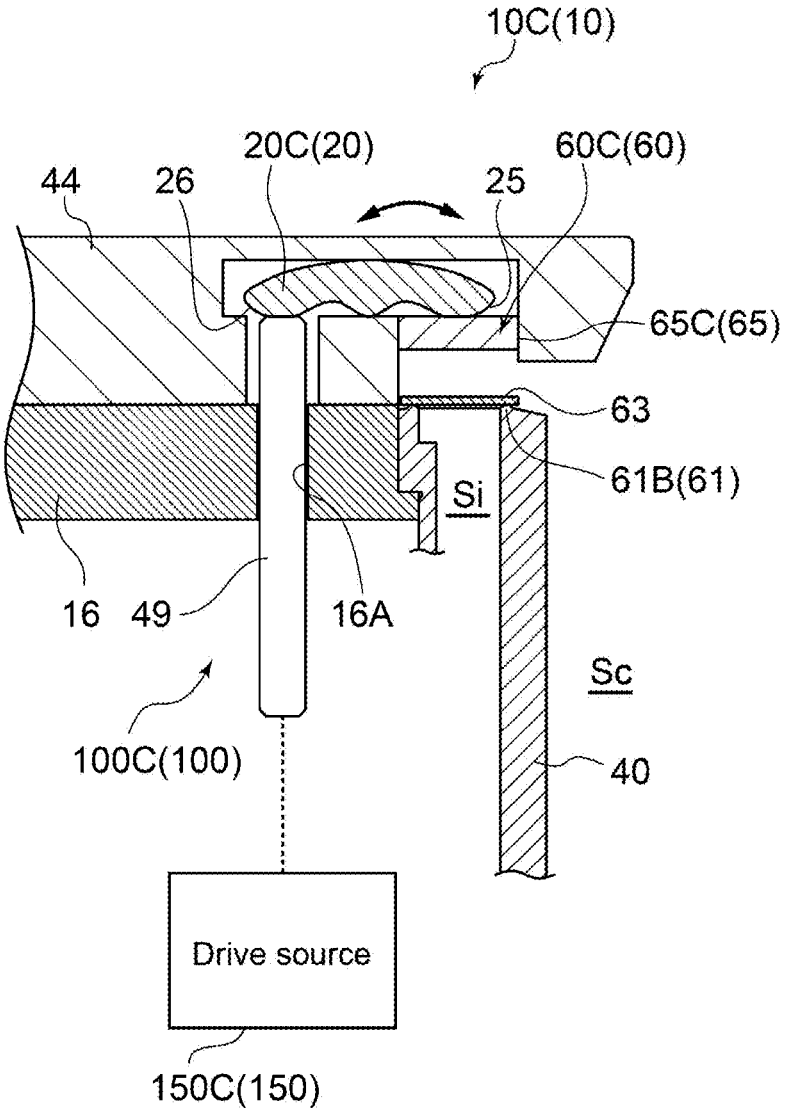
FIG. 8 is a cross-sectional view conceptually showing another reciprocating compressor according to the second embodiment.

The compressor 10B, 10C (10) according to the second embodiment will be exemplified with reference to FIG. 7, 8. FIG. 7 is a cross-sectional view conceptually showing the compressor 10B (10) according to the second embodiment. FIG. 8 is a cross-sectional view conceptually showing the compressor 10C (10) according to the second embodiment. The same configurations as the compressor 10A are indicated by the same reference signs in the drawings, and the description of the same configurations as the compressor 10A may be simplified or omitted. Further, the description of the same operations/advantages as the compressor 10A may also be omitted.

<3-1. Overview of Configuration of Compressor 10B, 10C>

As shown in FIG. 7, 8, in the compressor 10B, 10C (10) according to the second embodiment, an intake valve seat 61B (61) is formed integrally with the outer peripheral portion of the cylinder 40. Although detailed illustration is omitted, as an example, the intake valve seat 61B has a shape similar to the flange 47 described with reference to FIG. 5, and a channel similar to the channel 47A is formed (however, the second guide hole 172A is not formed). The intake valve seat 61B is configured to seat the intake valve 63.

As shown in FIGS. 7, 8, the compressors 10B, 10C (10) respectively include back members 65B, 65C (65) located on an opposite side of the intake valve 63 from the intake valve seat 61B. The back members 65B, 65C according to the second embodiment are configured to rise and descend with respect to the above-described valve plate 44. As an example, the back members 65B, 65C each have an O-ring shape extending continuously over the entire circumference in the circumferential direction of the cylinder 40.

In the compressors 10B, 10C according to the second embodiment, of the intake valve seat 61B or the back members 65B, 65C, the back members 65B, 65C move in the axial direction. Whereby, an upper end of a movable range of the intake valve seat 61 is adjusted in the axial direction. That is, the movable range of the intake valve 63 between the intake valve seat 61B and the back members 65B, 65C is changed. Hereinafter, in the description regarding the second embodiment, of the intake valve seat 61B or the back members 65B, 65C, the back members 65B, 65C may respectively be referred to as "movable parts 60B, 60C". The movable parts 60B, 60C (60) are moved by actuators 100B, 100C (100) which are components of the compressors 10B, 10C.

According to the above configuration, the compressors 10B, 10C include the actuators 100B, 100C for moving the movable parts 60B, 60C which are the back members 65B, 65C in the axial direction, and the actuators 100B, 100C change the movable range of the intake valve 63 between intake valve seat 61B and the back members 65B, 65C. Whereby, it is possible to change the channel cross-sectional area of the intake gas channel Ci formed between the activated intake valve 63 and the intake valve seats 61B, 61C. Therefore, it is possible to achieve the compressors 10B, 10C capable of adjusting step by step the gas intake amount in the cylinder 40.

Further, the movable parts 60B, 60C which are the back members 65B, 65C each have a ring shape extending continuously along the circumferential direction of the cylinder 40. Whereby, compared to a case where a plurality of movable parts 60B, 60C are arranged along the circumferential direction, the number of parts forming the compressors 10B, 10C is reduced, making it possible to simplify the configuration of the actuators 100B, 100C.

Further, since the movable parts 60B, 60C are the back members 65B, 65C, there is no need to move the intake valve seat 61B in the axial direction, making it possible to simplify the configuration of the actuators 100B, 100C.

<3-2. Details of Configuration of Actuators 100B, 100C>

As shown in FIGS. 7, 8, the actuators 100B, 100C include moving members 20B, 20C (20) for moving the movable parts 60B, 60C by driving forces transmitted from drive sources 150B, 150C.

The moving members 20B, 20C can narrow and widen the movable range of the intake valve 63 by moving the movable parts 60B, 60C, and are located on movable part 60B, 60C sides with respect to the intake valve 63 (in the example of FIG. 3, the upper side with respect to the intake valve 63). A plurality of moving members 20B, 20C of the present embodiment are disposed in accommodation holes formed in the valve plate 44, and are arranged along the circumferential direction of the cylinder 40.

In the embodiment shown in FIG. 7, the back member 65B includes an inclined surface 77 extending obliquely with respect to the radial direction of the cylinder 40. The back member 65B is biased toward a side opposite to the intake valve 63 by a spring 78 which is a component of the actuator 100B. With this biasing, it is possible to suppress the movement of the back surface member 65B to the intake valve 63 side, even if the pressure in the closed space within the cylinder chamber Sc decreases as the piston 42 descends, for example.

Further, the moving member 20B has a facing inclined surface 29 facing and abutting on the inclined surface 77, and is configured to move in the radial direction. The moving member 20B is operated by the drive source 150B (150) which may be, for example, a hydraulic cylinder, an air cylinder, a solenoid, or the like. When the moving member 20B receives power from the drive source 150B and moves radially inward, the facing inclined surface 29 pushes down the back member 65B against a biasing force of the spring 78 while sliding against the inclined surface 77. Whereby, the movable range of the intake valve 63 is narrowed. Conversely, when the moving member 20B moves radially outward, the back member 65B is pushed up by the biasing force of the spring 78, and the movable range of the intake valve 63 is widened. In addition to the biasing force of the spring 78, the back member 65B may be pushed up by, for example, the increased pressure in the closed space within the cylinder chamber Sc due to the rise of the piston 42.

According to the above configuration, the movement of the back member 65B along the axial direction is realized simply by sliding the facing inclined surface 29 against the inclined surface 77 as the moving member 20B moves in the radial direction. Whereby, it is possible to simplify the actuator 100B. Further, since the back member 65B is moved by the plurality of moving members 20B, the back member 65B can be moved more stably.

In the embodiment shown in FIG. 8, the moving member 20C disposed in the accommodation hole of the valve plate 44 is swingably disposed. One end 25 of the moving member 20C in a swinging direction abuts on the back member 65C from the side opposite to the intake valve 63, and another end 26 of the moving member 20C abuts on an actuating member 49 configured to move in the axial direction. The actuating member 49 is a component of the actuator 100C (100) and, as an example, is inserted through a guide hole 16A disposed in the crankcase 16. The actuating member 49 is moved in the axial direction by the drive source 150C which may be, for example, a hydraulic cylinder, an air cylinder, a solenoid, or the like. A ring member, such as the cam ring 130 illustrated using FIG. 5, may be interposed between the drive source 150C and the actuating member 49.

The back member 65C is moved in the axial direction and the movable range of the intake valve 63 is changed, by swinging the moving member 20C with the actuating member 49.

As described above, since the moving members 20B, 20C are located on the movable parts 60B, 60C sides with respect to the intake valve 63, the components of the actuators 100B, 100C are concentrated on the movable parts 60B, 60C sides with respect to the intake valve 63. Therefore, compared to a case where the moving members 20B, 20C are arranged, for example, on an intake valve seat 61B side with respect to the intake valve 63, the actuators 100B, 100C can be made more compact.

As another example of the second embodiment, the movable part 60B may obtain from oil a force for moving up and down. In this case, an oil-filled portion formed inside the valve plate 44 may be filled with oil, and a pressure of this oil may be adjusted by driving a hydraulic cylinder. The movable part 60B disposed so as to close the oil-filled portion moves in the axial direction in response to the pressure fluctuations of the oil.

4. Conclusion

The contents described in some embodiments described above would be understood as follows, for instance.

1) A reciprocating compressor (10) according to at least one embodiment of the present disclosure, includes: a cylinder (40) forming a cylinder chamber (Sc); an intake valve (63) disposed around the cylinder chamber (Sc); a movable part (60) including either an intake valve seat (61) configured to seat the intake valve (63) or a back member (65) located on an opposite side of the intake valve (63) from the intake valve seat (61), and configured to move in an axial direction of the cylinder (40); and an actuator (100) for moving the movable part (60) in the axial direction to change a movable range of the intake valve (63) between the intake valve seat (61) and the back member (65).

According to the above configuration 1), since the actuator (100) changes the movable range of the intake valve (63) between intake valve seat (61) and the back member (65), it is possible to change the channel cross-sectional area of the intake gas channel (Ci) formed between the activated intake valve (63) and the intake valve seat (61). Whereby, it is possible to achieve the reciprocating compressor (10) capable of finely adjusting a gas intake amount in the cylinder (40).

2) In some embodiments, the reciprocating compressor (10) according to the above 1), wherein the movable part (60) has a ring shape extending continuously along a circumferential direction of the cylinder (40).

According to the above configuration 2), compared to a case where a plurality of movable parts (60) are arranged along the circumferential direction, the number of parts forming the compressor (10) is reduced, making it possible to simplify the configuration of the actuator (100).

3) In some embodiments, the reciprocating compressor (10) according to the above 1) or 2), wherein the actuator (100) includes a moving member (20) for moving the movable part (60) such that the movable range of the intake valve (63) is narrowed, and wherein the moving member (20) is located on a side of the movable part (60) with respect to the intake valve (63).

According to the above configuration 3), since the moving member (20) is located on the movable part (60) side with respect to the intake valve (63), the components of the actuator (100) are concentrated on the movable part (60) side with respect to the intake valve (63). Whereby, the actuator (100) can be made more compact.

4) In some embodiments, the reciprocating compressor (10A) according to any of the above 1) to 3), wherein the movable part (60) is the intake valve seat (61A).

According to the above configuration 4), since the back member (65A) need not be moved, it is possible to simplify the configuration of the actuator (100A).

5) In some embodiments, the reciprocating compressor (10A) according to the above 4), wherein the actuator (100A) includes: a moving member (20A) located on an opposite side of the intake valve seat (61A) from the back member (65A) and configured to move in the axial direction; and a cam ring (130) located on an opposite side of the moving member (20A) from the intake valve seat (61A) and configured to rotate around an axis of the cylinder (40), and wherein the cam ring (130) has a cam surface (135) inclined with respect to a rotational direction and is configured such that the cam surface (135) sliding against the moving member (20A) as the cam ring (130) rotates moves the moving member (20A) and the intake valve seat (61A) toward the back member (65A).

According to the above configuration 5), since the configuration is adopted in which the rotational motion of the cam ring (130) is converted into the movement along the axial direction of the moving member (20A), it is possible to reduce the necessity of arranging a large number of movable parts of the actuator (100A) on the opposite side of the cam ring (130) from the moving member (20A). Therefore, the actuator (100A) can be made more compact in the axial direction.

6) In some embodiments, the reciprocating compressor (10A) according to the above 5), wherein the actuator (100A) further includes: a linear motion member (140) configured to rotate the cam ring (130) along with linear movement; and a drive source (150A) configured to provide a driving force to the linear motion member (140).

According to the above configuration 6), since the cam ring (130) rotates simply by the linear movement of the linear motion member (140) driven by the drive source (150A), it is possible to simplify the configuration of the actuator (100A).

7) In some embodiments, the reciprocating compressor (10A) according to the above 5) or 6), wherein a plurality of the moving members (20A) are arranged along a circumferential direction of the cylinder (40), and wherein a plurality of the cam surfaces (135) are disposed corresponding to the plurality of moving members (20A), respectively.

According to the above configuration 7), the plurality of cam surfaces (135) respectively slide against the plurality of moving members (20A), causing the plurality of moving members (20A) to move together with the intake valve seat (61A) toward the back member (65A). Since the intake valve seat (61A) is moved by the plurality of moving members (20A), it is possible to stabilize the movement of the intake valve seat (61).

8) In some embodiments, the reciprocating compressor (10A) according to any of the above 4) to 7), wherein the actuator (100A) includes guides (170) configured to guide the moving member (20A) in the axial direction.

According to the above configuration 8), since the moving member (20A) is moved by the guides (170), the actuator (100A) can move the intake valve seat (61A) more stably.

9) In some embodiments, the reciprocating compressor (10A) according to the above 8), wherein the cylinder (40) includes a flange (47) configured such that the intake valve seat (61A) is placed thereon, and wherein each of the guides (170) includes a guide hole (second guide hole 172A) which is disposed in the flange (47) and inside of which the moving member (20A) is arranged.

According to the above configuration 9), the moving member (20A) is located on the inner side relative to an outer peripheral end of the flange (47), which is configured such that the intake valve seat (61A) is placed thereon, in the radial direction of the cylinder (40). Therefore, the actuator (100A) can be made more compact in the radial direction of the cylinder (40).

10) In some embodiments, the reciprocating compressor (10A) according to any of the above 1) to 9), wherein the back member (65A) includes an intake valve guide surface (67) facing radially inward of the cylinder (40) and configured to guide the intake valve (63) in the axial direction.

According to the above configuration 10), since the intake valve (63) is guided in the axial direction by the intake valve guide surface (67), the intake valve (63) can stably be activated even when an axial distance between the intake valve seat (61A) and the back member (65A) is changed by the actuator (100A).

11) In some embodiments, the reciprocating compressor (10B, 10C) according to any of the above 1) to 3), wherein the movable part (60B, 60C) is the back member (65B, 65C).

According to the above configuration 11), since the intake valve seat (61A) need not be moved, it is possible to simplify the configuration of the actuator (100B, 100C).

12) In some embodiments, the reciprocating compressor (10B, 10C) according to the above 11), wherein the back member (65B, 65C) includes an inclined surface (77) inclined with respect to a radial direction of the cylinder (40), and wherein the actuator (100B, 100C) includes a moving member (20B, 20C) having a facing inclined surface (29) facing and abutting on the inclined surface (77), and configured to move along the radial direction to move the back member (65B, 65C) in the axial direction.

According to the above configuration 12), the movement of the back member (65B, 65C) along the axial direction is realized simply by sliding the facing inclined surface (29) against the abutment inclined surface (77) as the moving member (20B, 20C) moves in the radial direction. Whereby, it is possible to simplify the actuator (100B, 100C).

13) In some embodiments, the reciprocating compressor (10B, 10C) according to the above 12), wherein a plurality of the moving members (20B, 20C) are arranged along a circumferential direction of the cylinder (40).

According to the above configuration 13), since the back member (65B, 65C) is moved by the plurality of moving members (20B, 20C), the back member (65B, 65C) can be moved more stably.

REFERENCE SIGNS LIST

10: Reciprocating compressor
20: Moving member
29: Facing inclined surface
40: Cylinder
47: Flange
60: Movable part
61: Intake valve seat
63: Intake valve
65: Back member
67: Intake valve guide surface
77: Inclined surface
100: Actuator
130: Cam ring
135: Cam surface
140: Linear motion member
150: Drive source
170: Guide
172A: Second guide hole (guide hole)
Sc: Cylinder chamber

The invention claimed is:

1. A reciprocating compressor, comprising:
a cylinder forming a cylinder chamber;
an intake valve disposed around the cylinder chamber;
a piston configured to reciprocate inside the cylinder;
an intake valve seat configured to seat the intake valve;
a back member located on an opposite side of the intake valve from the intake valve seat; and
an actuator configured to move a movable part including either the intake valve seat or the back member in an axial direction of the cylinder to change a movable range of the intake valve between the intake valve seat and the back member,
wherein the actuator is configured to change the movable range of the intake valve during an operating cycle that includes an intake stroke, in which a gas is sucked into the cylinder chamber, and a discharge stroke, in which the gas compressed by the piston is discharged from the cylinder chamber.

2. The reciprocating compressor according to claim 1,
wherein the movable part has a ring shape extending continuously along a circumferential direction of the cylinder.

3. The reciprocating compressor according to claim 1,
wherein the actuator includes a moving member for moving the movable part such that the movable range of the intake valve is narrowed, and
wherein the moving member is located on a side of the movable part with respect to the intake valve.

4. The reciprocating compressor according to claim 1,
wherein the back member includes an intake valve guide surface facing radially inward of the cylinder and configured to guide the intake valve in the axial direction.

5. The reciprocating compressor according to claim 1,
wherein the movable part is the back member.

6. The reciprocating compressor according to claim 1,
wherein the movable part is the intake valve seat.

7. The reciprocating compressor according to claim 6,
wherein the actuator includes guides configured to guide the moving member in the axial direction.

8. The reciprocating compressor according to claim 7,
wherein the cylinder includes a flange configured such that the intake valve seat is placed thereon, and
wherein each of the guides includes a guide hole which is disposed in the flange and inside of which the moving member is arranged.

9. A reciprocating compressor, comprising:
a cylinder forming a cylinder chamber;
an intake valve disposed around the cylinder chamber;
an intake valve seat configured to seat the intake valve;
a back member located on an opposite side of the intake valve from the intake valve seat; and
an actuator configured to move a movable part including the intake valve seat in an axial direction of the cylinder to change a movable range of the intake valve between the intake valve seat and the back member,
wherein the actuator includes:
a moving member located on an opposite side of the intake valve seat from the back member and configured to move in the axial direction; and
a cam ring located on an opposite side of the moving member from the intake valve seat and configured to rotate around an axis of the cylinder, and
wherein the cam ring has a cam surface inclined with respect to a rotational direction and is configured such that the cam surface sliding against the moving member as the cam ring rotates moves the moving member and the intake valve seat toward the back member.

10. The reciprocating compressor according to claim 9,
wherein the actuator further includes:
a linear motion member configured to rotate the cam ring along with linear movement; and
a drive source configured to provide a driving force to the linear motion member.

11. The reciprocating compressor according to claim 9,
wherein a plurality of the moving members are arranged along a circumferential direction of the cylinder, and
wherein a plurality of the cam surfaces are disposed corresponding to the plurality of moving members, respectively.

12. A reciprocating compressor, comprising:
a cylinder forming a cylinder chamber;
an intake valve disposed around the cylinder chamber;
an intake valve seat configured to seat the intake valve;

a back member located on an opposite side of the intake valve from the intake valve seat; and an actuator configured to move a movable part including the back member in an axial direction of the cylinder to change a movable range of the intake valve between the intake valve seat and the back member, wherein the back member includes an inclined surface inclined with respect to a radial direction of the cylinder, and wherein the actuator includes a moving member having a facing inclined surface facing and abutting on the inclined surface, and configured to move along the radial direction to move the back member in the axial direction.

13. The reciprocating compressor according to claim 12, wherein a plurality of the moving members are arranged along a circumferential direction of the cylinder.

* * * * *